United States Patent [19]

Kücherer

[11] Patent Number: 5,027,999

[45] Date of Patent: Jul. 2, 1991

[54] CAN-SHAPED CARTON

[75] Inventor: Helmut Kücherer, Schriesheim, Fed. Rep. of Germany

[73] Assignee: Weidenhammer Packungen KG GmbH & Co., Hockenheim, Fed. Rep. of Germany

[21] Appl. No.: 564,641

[22] Filed: Aug. 9, 1990

[30] Foreign Application Priority Data

Aug. 23, 1989 [DE] Fed. Rep. of Germany ..... 3927825

[51] Int. Cl.[5] ..... B65D 41/56

[52] U.S. Cl. ..... 229/125.08; 220/254; 220/270

[58] Field of Search ..... 220/254, 270; 229/125.08

[56] References Cited

U.S. PATENT DOCUMENTS

| | | | |
|---|---|---|---|
| 4,741,450 | 5/1988 | Braude | 220/254 |
| 4,874,103 | 10/1989 | Quisenberry et al. | 220/254 |
| 4,936,494 | 6/1990 | Weidman | 220/254 |

FOREIGN PATENT DOCUMENTS

| | | |
|---|---|---|
| 2911055 | 3/1979 | Fed. Rep. of Germany . |
| 3038123 | 9/1980 | Fed. Rep. of Germany . |
| 3345565 | 12/1983 | Fed. Rep. of Germany . |
| 3825003 | 7/1988 | Fed. Rep. of Germany . |
| 627141 | 12/1978 | Switzerland . |

*Primary Examiner*—Joseph Man-fu Moy
*Attorney, Agent, or Firm*—Bachman & LaPointe

[57] ABSTRACT

A can-shaped carton has a body made of a compound of paper and/or cardboard with a plastic coating provided at least on the inside, a bottom sealed to the body, an originality closure sealed to the opposite end face, which closure is opened for the removal of the packed material, and a lid made of plastic for closing the carton again. A simple and inexpensive as well as environmentally friendly embodiment is obtained by the fact that the lid consists of a plastic annular part, which is substantially of the same contour as the body and is sealed on to the end face of the latter, and a disc which is made of a compound of paper and/or cardboard, is moulded into the annular part, spans the body at the end and is covered along its circumference by a narrow strip of material of the annular part which, in turn, is separable over a part of its circumference.

14 Claims, 1 Drawing Sheet

FIG. 1
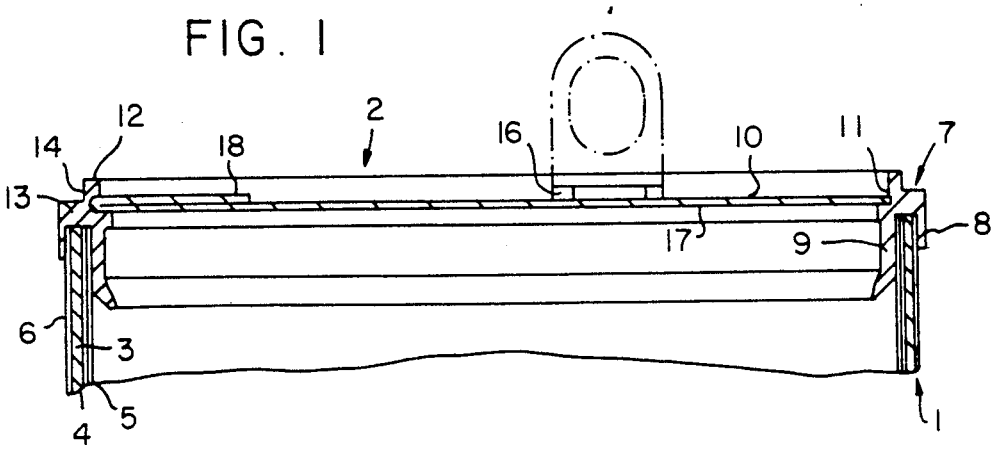
FIG. 2
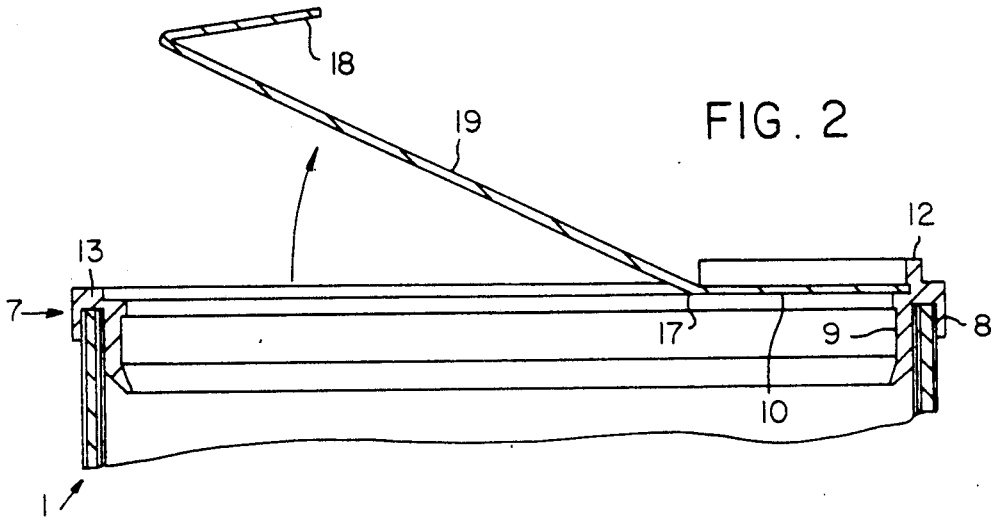
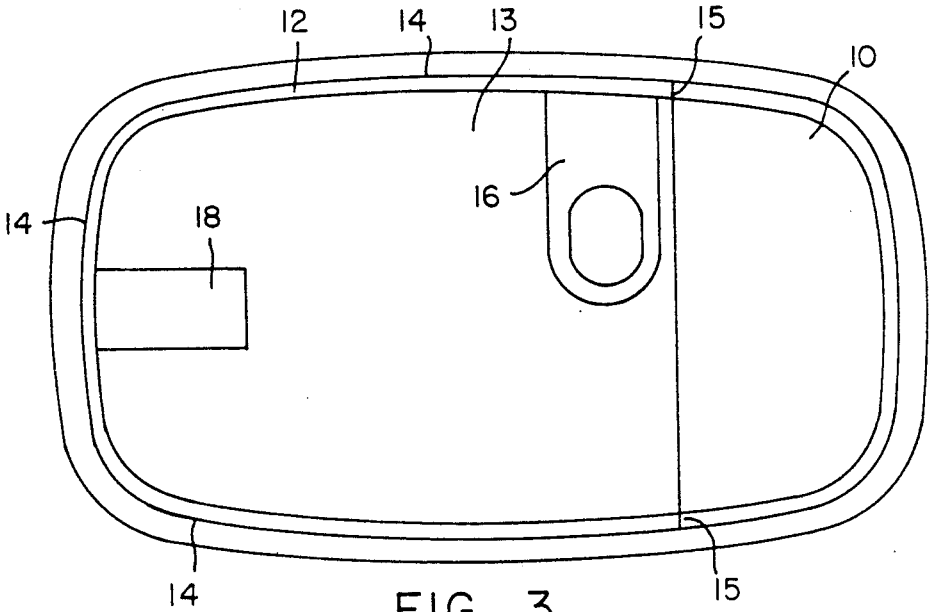
FIG. 3

CAN-SHAPED CARTON

The invention relates to a can-shaped carton having a body made of a compound of paper and/or cardboard with a plastic coating provided at least on the inside, a bottom sealed to the body, an originality closure sealed to the opposite end face, which closure is opened for the removal of the packed material, and a lid made of plastic for closing the carton again.

Cartons of the abovementioned type, which can also be described as combined cans, serve primarily for accommodating fluid packed materials, such as powder for instant drinks, viscous to pasty foodstuffs, such as jams or the like. Compared with pure plastic or metal cartons, they are distinguished by relatively low material costs and furthermore by the fact that the used carton can be treated in an environmentally friendly manner. As a rule, the construction of these cartons is cylindrical, oval or rectangular with rounded corners. They have one or more layers of paper, paperboard or cardboard and, as a rule, have a diffusion-tight barrier layer made of a metal foil, metal paint or a plastic coating. In order to obtain a sufficient tightness, the bottom is, as a rule, sealed to the body by a hot-melt process. Provided as a rule on the lid side is a closure membrane made of a metal foil which is likewise sealed on to the end face of the body. This closure membrane, in turn, is provided with a pulling off tab and, if required, an intended break line in order to be able to separate it easily. In this case, the closure membrane not only forms the tight sealing of the carton, but it simultaneously also forms an originality closure.

In order to protect the packed material after separation of the closure membrane, a separate plastic lid is generally provided in the form of an immersion or inversion lid which is formed as an injection molding. The lid serves simultaneously as a stabilizing element for transport, storage and keeping in the household in order to keep the not sufficiently dimensionally stable body in shape in the region of the closure membrane or, after its separation, in the region of the opening.

The underlying object of the invention is to simplify a carton of the abovementioned construction in terms of design and, in terms of cost, to design it in a more favorable and environmentally friendly manner.

According to the invention, this object is achieved in that the lid consists of a plastic annular part, which is substantially of the same contour as the body and is sealed on to the end face of the latter. A disc which is made of a compound of paper and/or cardboard, is molded into the annular part, spans the body at the end and is covered along its circumference by a narrow strip of material of the annular part which, in turn, is separable over a part of its circumference.

In the case of the carton constructed according to the invention, the previously required closure membrane is firstly dispensed with by the lid itself being sealed on to the body and thus forming the closure ensuring the necessary tightness. Simultaneously, the sealed on lid constitutes the originality closure. In contrast to the known embodiment, however, the lid does not consist completely of plastic, but only around the circumference of the annular part which is sealed on to the body. Nevertheless, this annular part lends the carton a sufficient dimensional stability. The main part of the lid is formed from a disc made of paperboard, cardboard or a compound of paper or cardboard which spans the cross section of the body. This disc only needs to have a dimensional stability which prevents denting. During manufacture of the annular part, said disc is molded into the plastic mass by way of injection molding, it being overlapped at the top by a strip of material of the annular part which extends along the circumference of the disc. This strip of material can be separated from the annular part at least over a part of the circumference, with the result that the disc is exposed in this region and can be lifted upwards in order, in this manner, to be able to remove the packed material. By renewed pressing of the disc against the annular part, the container can be closed again.

In the case of the carton constructed according to the invention, not only the closure membrane is dispensed with, but plastic mass is also spared in the lid and this mass is replaced by a material which is easier and more environmentally friendly to process. In total, a carton is thus obtained which, in terms of material expenditure and production technology, can be manufactured in a less expensive manner and which largely consists of a material which can be treated in an environmentally friendly manner. Additionally, printing on the lid surface can be effected in a more favorable and easier manner than is the case with a pure plastic lid.

Although container lids, which consist of a compound of plastic and paperboard, have already been proposed in packaging technology, in this case it is a simple inversion or immersion lid which neither fulfils the object of a tightness and originality closure nor has an integrated opening mechanism.

A preferred embodiment is distinguished by the fact that the disc has a prefabricated bending line which approximately coincides with the connection line of the end points of the separable part of the strip of material.

In this manner, the disc can be lifted or folded up without problems after separation of the strip of material in order to be able to remove the packed material. The folding up part of the disc can likewise easily be returned to the closed position. In this case, the bending line can be designed and made in such a way that it exerts a return force on the folding part of the disc, which force urges it into the closed position. Instead of this or additionally, it is also possible to leave small projections or the like on the annular part in the region of the separated strip of material in order to be able to engage the folding up part of the disc in the closed position.

The partially separable strip of material is expediently provided with a pulling off tab which facilitates its separation, this pulling off tab being advantageously molded on to the annular part in a position parallel to the disc and being able to be bent upwards in order to obtain an approximately flat lid surface in the new state.

It is furthermore advantageous if the disc is provided with a pull tab on the side opposite the bending line so that the part of the disc provided for opening can also be folded back without problems.

In a further preferred embodiment, provision is made for the partially separable strip of material simultaneously to form an upwardly projecting stack edge for the bottom of an identical carton.

The partially separable strip of material in the original state of the carton thus forms a stack edge for transport, storage and presentation of the carton. When the carton reaches the final user, the stack edge is no longer required and it can thus be partially separated in order to be able to open the carton and to remove the packed material.

According to a further advantageous exemplary embodiment, provision is made for the annular part to have two concentric shoulders tightly overlapping the body at the top and on the outside and inside.

In this manner, not only is it possible for there to be a satisfactory tight sealing of the annular part to the body, but the annular part can also satisfactorily fulfil its stabilizing function in relation to the body.

The disc can have at least one diffusion-tight, e.g. metallic, barrier layer. The latter can be of substantially thinner construction compared to the previously required closure membrane. While conventional closure membranes have a wall thickness of 50 μm, a 9 μm coating is sufficient for the disc. By this means, and by the saving of a large part of plastic mass, a weight saving in the region of ⅓ is achieved in respect of the closure.

The invention is described below with reference to an exemplary embodiment represented in the drawing, in which:

FIG. 1 shows a cross section in the upper region of the carton in the original state;

FIG. 2 shows a section similar to FIG. 1 in the open state and

FIG. 3 shows a plan view of the carton according to FIG. 1.

Of the can-shaped carton represented in the drawing, only the body 1 and the top closure 2 are represented, but not the bottom sealing. The body 1 consists of a compound 3 of paper or paperboard which has on the inside a metallic barrier layer 4 and a plastic coating 5 and on the outside a paper coating 6 for printing. The body 1 is sealed on its end face opposite the bottom by a closure 2 in the form of a lid.

The lid 2 consists of an annular part 7 made of plastic which tightly overlaps the body 1 at the top and on the outside and inside with two downwardly projecting concentric shoulders 8, 9. The annular part 7 is sealed on to the body 1, for example using the inside plastic coating 5.

Furthermore, the lid 2 has a disc 10 made of paperboard or a compound of paperboard which spans the cross section of the body 1 and is embedded, e.g. injection molded, in the annular part 7 along its circumference 11. In the exemplary embodiment shown, the annular part 7 has for this purpose an upwardly projecting strip 12 of material which simultaneously forms a stack edge. This strip 12 of material overlaps the disc 10 along its entire circumference. In this case, a material weakening acting as an intended break line 14 is provided between the strip 12 of material and the region 13 overlapping the end face of the body 1. This intended break line 14 extends, as is evident from FIG. 3, along three sides of the, in this case, rectangular carton. Furthermore, as is shown in FIG. 3, the strip 12 of material has separation or cutting points 15. Molded on to the strip 12 of material is a pulling off tab 16 which, in the original state, as is visible in FIG. 3, rests on the disc 10 and, as shown in FIG. 1, can be bent upwards. By means of the pulling off tab the strip 12 of material can be separated from the annular part along the intended break lines 14 between the separation points 15 so that only the part of the strip of material visible on the right in FIGS. 2 and 3 remains.

The disc 10 is provided with a molded-in bending line 17 approximately along the connection line of the separation or cutting points 15. Furthermore, on the side opposite the bending line 17, the disc has a pull tab 18 which is molded on to the annular part and, in the original state, rests flatly on the disc. After separation of the strip 12 of material, the pull tab 18 can be gripped and the disc can be lifted on this side of the bending line 17. With its section 19, the disc 10 thus forms a type of cap lid.

I claim:

1. A can-shaped carton which comprises: a body portion having an end face; a mouth portion adjacent the end face; an originality closure sealed to the end face which is opened for removal of the contents of the carton and including a lid for closing the carton after opening, said closure including an annular part substantially of the same contour as the body and sealed onto the end face, a disc having a circumference seated in the annular part and spanning the body at the end face, and a strip affixed to the annular part and covering the circumference of the disc, wherein said strip is separable from the annular part over a part of the circumference of the disc to expose the circumference of the disc in the separable area of the strip and to permit opening and closing of the disc.

2. A carton according to claim 1 wherein the body has an inside and outside and is made of a material selected from the group consisting of paper, cardboard and mixtures thereof, and the disc is made of a material selected from the group consisting of paper, cardboard and mixtures thereof.

3. A carton according to claim 2 wherein the disc is molded into the annular part.

4. A carton according to claim 2 wherein the strip is a narrow strip of material of the annular part.

5. A carton according to claim 1 wherein the strip includes end points defining the separable part thereof and wherein the disc has a prefabricated bending line which approximately coincides with the end points.

6. A carton according to claim 1 wherein the partially separable strip is provided with a pulling off tab.

7. A carton according to claim 6 wherein the tab is molded on to the annular part and is disposed on the disc and is operable to be bent upwards.

8. A carton according to claim 5 including a pull tab means on the disc on the side opposed to the bending line.

9. A carton according to claim 1 wherein said partially separable strip forms an upwardly projecting stack edge for the bottom of an identical carton.

10. A carton according to claim 1 wherein the annular part includes two downwardly projecting concentric shoulders tightly overlapping the body adjacent the end face.

11. A carton according to claim 1 wherein said carton includes at least one barrier layer.

12. A carton according to claim 2 wherein the body has a plastic coating at least on the inside thereof.

13. A carton according to claim 12 wherein the annular part is made of plastic and is sealed onto the end face by sealing onto the inside plastic coating of the body.

14. A carton according to claim 1 including a material weakening break line between the strip and the annular part to define the separable area of the strip.

* * * * *